US008801548B2

(12) United States Patent
Swingle et al.

(10) Patent No.: US 8,801,548 B2
(45) Date of Patent: Aug. 12, 2014

(54) TENNIS AND GOLF TRAINING DEVICE HAVING AN ADJUSTABLE HOOP

(76) Inventors: Charles E. Swingle, Murrieta, CA (US); Wilhelm D. Behrens, Murrieta, CA (US)

( * ) Notice: Subject to any disclaimer, the term of this patent is extended or adjusted under 35 U.S.C. 154(b) by 357 days.

(21) Appl. No.: 13/136,772

(22) Filed: Aug. 9, 2011

(65) Prior Publication Data

US 2012/0040769 A1 Feb. 16, 2012

Related U.S. Application Data

(60) Provisional application No. 61/372,582, filed on Aug. 11, 2010.

(51) Int. Cl.

| | |
|---|---|
| ***A63B 69/38*** | (2006.01) |
| ***A63B 69/36*** | (2006.01) |
| ***A63B 63/00*** | (2006.01) |
| *A63B 71/02* | (2006.01) |

(52) U.S. Cl.

CPC ..... *A63B 69/3623* (2013.01); *A63B 2225/09* (2013.01); *A63B 69/38* (2013.01); *A63B 2210/50* (2013.01); *A63B 2225/093* (2013.01); *A63B 63/00* (2013.01); *A63B 71/023* (2013.01)

USPC ..... 473/462; 473/195; 473/196; 473/459; 473/409

(58) Field of Classification Search

USPC ..... 473/422, 459, 462, 173, 195, 196, 409

See application file for complete search history.

(56) References Cited

U.S. PATENT DOCUMENTS

| | | | | |
|---|---|---|---|---|
| 4,160,549 | A * | 7/1979 | Simpson | 473/462 |
| 4,718,668 | A * | 1/1988 | Schipske | 473/462 |
| 6,312,349 | B1 * | 11/2001 | Roberts | 473/448 |
| 7,740,550 | B1 * | 6/2010 | Kaufman | 473/459 |
| 8,187,125 | B2 * | 5/2012 | Kaufman | 473/459 |
| 2005/0134001 | A1 * | 6/2005 | Rowan | 273/401 |
| 2005/0192126 | A1 * | 9/2005 | Remaklus | 473/447 |
| 2010/0261559 | A1 * | 10/2010 | Kaufman | 473/459 |
| 2011/0059817 | A1 * | 3/2011 | Fleming et al. | 473/459 |
| 2013/0040762 | A1 * | 2/2013 | Swingle et al. | 473/422 |

* cited by examiner

*Primary Examiner* — Raleigh W Chiu
(74) *Attorney, Agent, or Firm* — Morland C. Fischer

(57) ABSTRACT

A portable training device to be used by one practicing the game of tennis or golf. The training device includes a stand to rest on a flat surface, an adjustable hoop through which a tennis ball or a golf ball is hit, and a hoop support extending between the stand and the hoop. The adjustable hoop is rotatable between a vertical position, standing upwardly from and in axial alignment with the hoop support, and a horizontal position, facing the flat surface in perpendicular alignment with the hoop support. The length of the hoop support is adjustable so that the distance between the hoop and the stand can be correspondingly adjusted to meet the needs of the user.

20 Claims, 6 Drawing Sheets

TENNIS AND GOLF TRAINING DEVICE HAVING AN ADJUSTABLE HOOP

CROSS REFERENCES TO RELATED APPLICATIONS

This application is related to Provisional Patent Application No. 61/372,582 filed Aug. 11, 2010.

BACKGROUND OF THE INVENTION

1. Field of the Invention

This invention relates to an adjustable training device to be used by those wishing to practice playing tennis or golf. The training device has a hoop that can be elevated or lowered and rotated between vertical and horizontal positions to enable the player to hit a ball through the hoop at different locations and thereby practice a variety of different shots and techniques.

2. Background Art

It is known that tennis and golf players wishing to practice their game will use a target to which a ball is hit. In the case of tennis, a player will stand on one side of the tennis net and move the target to the opposite side of the net. The player tries to hit a tennis ball over the net so as to land close to the target. In the case of golf, a player will place the target on the green or fairway at a particular distance and then try to hit a golf ball so as to land close to the target.

Although the player may be able to hit his tennis or golf ball close to the target, there is nothing between the player and the target to help the player improve the fundamentals of his game. For example, despite the tennis player being able to hit his tennis ball to a designated target on the court, there is no way to ensure the proper form and ball location during the player's serve, ground strokes, volley, etc. relative to the net. Likewise, there is nothing to enable the golfer to improve the form of his strokes and the flight of the ball while pitching, driving, etc.

Therefore, what would be advantageous is a portable practice device to be used with and without a target and by both tennis players and golfers, where the practice device is adjustable so that the players can hit their tennis and golf balls towards the device in order to practice different strokes and hitting techniques over different distances and thereby improve their form.

SUMMARY OF THE INVENTION

In general terms, a portable tennis and golf training device is disclosed to be used to enable a player to practice his tennis and golf strokes by hitting a tennis or golf ball through an adjustable hoop. The training device has a stand with a set of collapsible and extendable legs to enhance stability when the device is laid on a tennis court, grass or other flat surface. A hollow tubular lower height adjustment member is coupled to and extends vertically upward from the stand. A hollow tubular intermediate height adjustment member is telescopically received by and slidable through the lower height adjustment member. A hollow tubular upper height adjustment member is telescopically received by and slidable through the intermediate height adjustment member. The lower, intermediate and upper height adjustment members can be pulled upwardly and outwardly so as to stand in vertical end-to-end alignment one above the other. Threaded compression nuts surround and interlock the overlapping ends of the lower, intermediate and upper height adjustment members so as to maintain the vertical end-to-end alignment thereof above the stand.

The practice device includes an adjustable hoop that is coupled to and rotatable relative to the upper height adjustment member by means of a hoop carrier. The hoop is preferably circular, but may include one or more flat sides or a plurality of arcuate sides that are detachably connected together. One end of the hoop carrier is pivotally connected to the upper height adjustment member. A mounting sleeve having a channel running longitudinally therethrough is fixedly connected to the opposite end of the hoop carrier. The adjustable hoop is received by and retained within the channel through the mounting sleeve. A curved guide rail is detachably connected to the top of the upper height adjustment member. The hoop carrier is adapted to rotate over the curved guide rail to cause a corresponding rotation of the mounting sleeve and the hoop that is retained by the mounting sleeve so that the position of the hoop is adjustable through an arc which extends between a vertical position facing the player and a horizontal position facing the ground. Once the position of the hoop is selected, a fastener (e.g., a pull pin) is removably inserted through axially-aligned holes formed in the hoop carrier and the guide rail to prevent a displacement of the hoop carrier and the hoop which is carried thereby.

In operation, once the position of the hoop is selected and locked in place by the fastener, the stand of the practice device is stationed as desired on a tennis court adjacent the net or on a green or fairway of a golf course. The tennis or golf player practices his stroke and form while attempting to hit a tennis ball or golf ball through the hoop which extends above the stand.

DESCRIPTION OF THE PREFERRED EMBODIMENT

Figure 1:
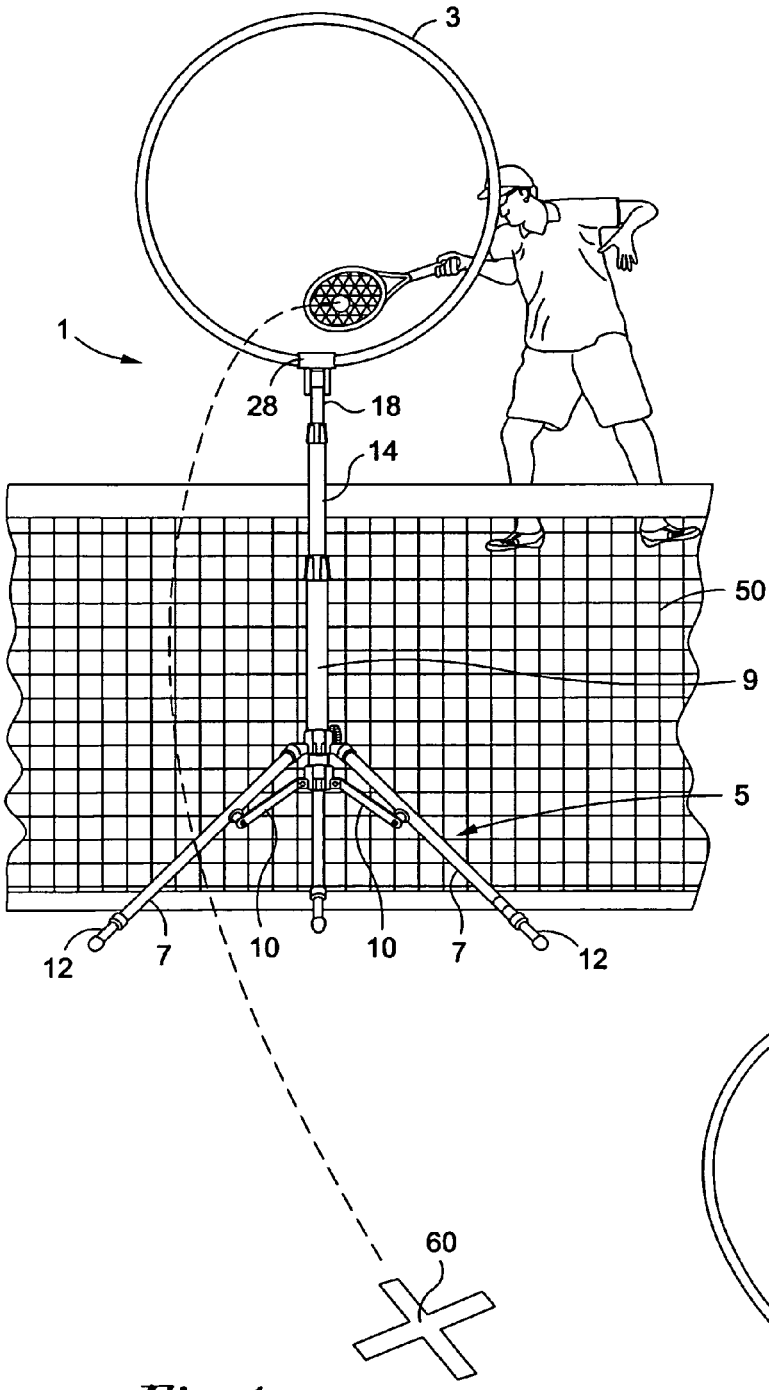
FIG. 1 shows a training device having an adjustable hoop according to a first preferred embodiment of this invention located adjacent a tennis net for use by a tennis player.

Referring initially to FIG. 1 of the drawings, there is shown a portable tennis training device 1 according to a first preferred embodiment of this invention. The tennis training device 1 is ideally positioned adjacent a net 50 of the kind typically found on a tennis court. However, the tennis training device 1 of this invention can also be used on any flat surface without a net or with any suitable barrier having a height which simulates the height of the usual tennis net. The tennis training device 1 is preferably used in combination with a movable target 60 which is laid on the tennis court behind the tennis net 50. The training device 1 and target 60 can be stationed on the tennis court to lie at either the same or opposite sides of the tennis net 50.

As will be described in greater detail hereinafter, the tennis training device 1 includes a hoop 3 at the top thereof. The position of the hoop 3 can be selectively adjusted relative to the tennis net 50 in both linear (i.e., vertical) and rotational directions so that a tennis player can practice his form and strokes while hitting a tennis ball through the hoop. The player can use the tennis training device 1 with or without the target 60. In the case where the target 60 is employed, the position of the hoop 3 and the location of the target 60 can be adjusted relative to one another so that the player practices hitting a tennis ball through the hoop to land close to the target.

The adjustable hoop 3 enables the player to practice his volley shots while standing close to the hoop and/or his serve and ground strokes standing away from the hoop. At the same time, the position of the hoop 3 above the net 50 can be selectively adjusted depending upon the age and height of the player. In any case, the hoop 3 of training device 1 helps the player practice hitting a tennis ball to a particular location and elevation above the net 50 so as to reach the target 60. For more advanced players, the player can also practice applying spin to a ball and the arc along which the tennis ball must travel to pass through the hoop 3 from different positions on the tennis court. What is more, the hoop 3 can be lowered so that the bottom thereof lies below the top of the tennis net 50. This will cause the player to practice hitting the tennis ball through a smaller hoop area lying close to and just above the top of the net 50 which is desirable in many game situations.

Figure 1A:
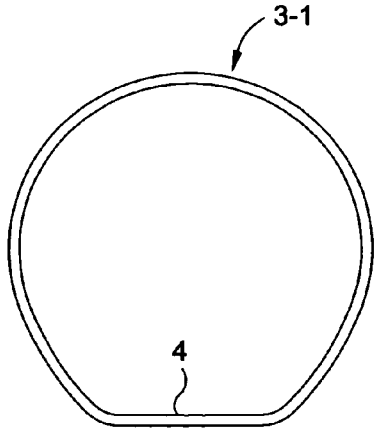
FIG. 1A shows a variation of the adjustable hoop from the training device illustrated in FIG. 1 wherein the hoop has at least one flat side.

The hoop 3 of tennis training device 1 is shown in FIG. 1 as being circular. In this case, it has been found that a hoop diameter of about 31 inches is ideal for practicing most tennis shots. It is to be understood that the hoop 3 can have a variety of different configurations and shapes. By way of example, a circular hoop 3-1 can be manufactured with a flat (i.e., straight) bottom 4 like that shown in FIG. 1A for an advantage that will be described when referring to FIGS. 3 and 4. By way of another example, the hoop 3 can have flat rather than round sides. The hoop 3 is preferably manufactured from any suitable impact-resistant material such as plastic, metal, wood, or the like.

Figure 2:
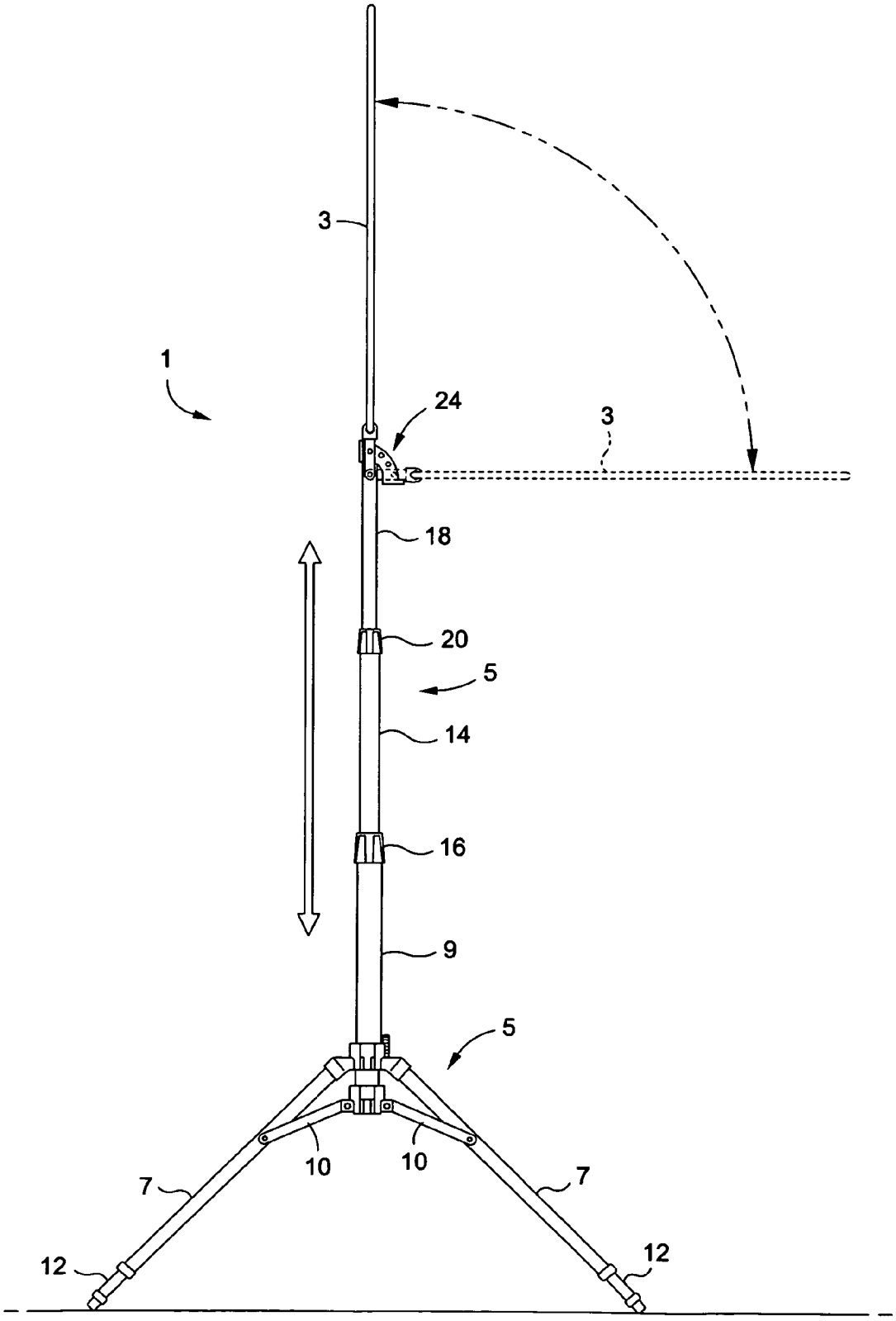
FIG. 2 shows an enlargement of the training device of FIG. 1 with the adjustable hoop standing above a hoop support and a stand and being rotatable relative to the hoop support between vertical and horizontal positions.

Referring now to FIG. 2 of the drawings, details are provided of the tennis training device 1 that was described while referring to FIG. 1. The training device 1 includes a stand 5 to be seated upon the tennis court adjacent the net 50 as shown in FIG. 1. The stand 5 has a set of collapsible legs 7 that are common to a tripod to enhance the stability of the device 1. The legs 7 are coupled to a hollow tubular lower height adjustment member 9 of a hoop support by means of hinges 10. Thus, the legs 7 are adapted to be folded (i.e., rotated) at the hinges 10 relative to the lower height adjustment member 9 from an outstretched position, as shown, to a collapsed position in axial alignment with the lower height adjustment member 9 to facilitate storage or transport of the training device 1. As an option, each of the legs 7 of the stand 5 may have a retractable extension 12 that is slidably received within the leg 7.

The hoop support of the tennis training device 1 also includes a hollow tubular intermediate height adjustment member 14. The intermediate height adjustment member 14 is shaped and sized (i.e., with a smaller diameter) so as to be slidably and telescopically received within the hollow tubular lower height adjustment member 9. The intermediate height adjustment member 14 can be pulled outwardly or pushed inwardly of the lower height adjustment member 9 as is needed in order to correspondingly adjust the height above the base 5 of the hoop 3 that is carried at the top of the training device 1.

FIG. 2 shows the intermediate height adjustment member 14 pulled upwardly and outwardly from the lower height adjustment member 9 so as to be in vertical end-to-end alignment therewith. In its upstanding position as shown, the lower or bottom end of the intermediate height adjustment member 14 is received inside and releasably attached to the upper end or top of the lower height adjustment member 9.

A well-known threaded compression nut 16 which surrounds the intermediate height adjustment member 14 is rotated into mating engagement with a correspondingly threaded portion of the lower height adjustment member 9 so that the overlapping ends of the lower height adjustment member 9 and the intermediate height adjustment member 14 will be held in place standing vertically one above the other. Rather than the aforementioned threaded nut 16, a removable locking pin (not shown) can be inserted through axially-aligned locking holes (also not shown) in order to hold the intermediate and lower height adjustment members 14 and 9 one above the other. By way of example, a suitable locking pin can be any of a spring-loaded plunge pin, hitch pin, pull ring pin, or the like.

The hoop support of the tennis training device 1 also includes a hollow tubular upper height adjustment member 18. The upper height adjustment member 18 is shaped and sized (i.e., with a smaller diameter) to be slidably and telescopically received within the intermediate height adjustment member 14. The upper height adjustment member 18 can be pulled outwardly or pushed inwardly of the intermediate height adjustment member 14 as is needed to correspondingly adjust the height above the base 5 of the hoop 3 that is carried at the top of the training device 1. FIG. 2 shows the upper height adjustment member 18 pulled upwardly and outwardly from the intermediate height adjustment member 14. In its upstanding position as shown, the lower end or bottom of the upper height adjustment member 18 is received inside and releasably attached to the upper end or top of the intermediate height adjustment member 14.

A threaded compression nut 20 which surrounds the upper height adjustment member 18 is rotated into mating engagement with a correspondingly threaded portion of the intermediate height adjustment member 14 so that the overlapping ends of the upper and intermediate height adjustment members 18 and 14 will be held in place standing upwardly one above the other. The threaded nut 20 which holds the overlapping ends of the height adjustment members 14 and 18 may be identical to that described when referring to the end-to-end engagement of the intermediate height adjustment member 14 to the lower height adjustment member 9.

The previously described adjustable hoop 3 is coupled to the top of the hollow upper height adjustment member 18 of the training device 1 so that the hoop 3 can be rotated continuously relative to member 18 through an arc of about 90 degrees from a vertical position, in axial alignment with the upper height adjustment member 18, to a horizontal position, in perpendicular alignment with member 18. In its vertical position, the central opening through the hoop 3 will face the player to enable serves, volleys, ground strokes, etc. to be practiced. In its horizontal position, the central opening through the hoop 3 will be parallel to the ground to enable dropshots to be practiced. As will soon be explained, the adjustable hoop 3 can be rotated to any location between the vertical and horizontal positions described above depending upon the training activity of the player.

Figure 3:
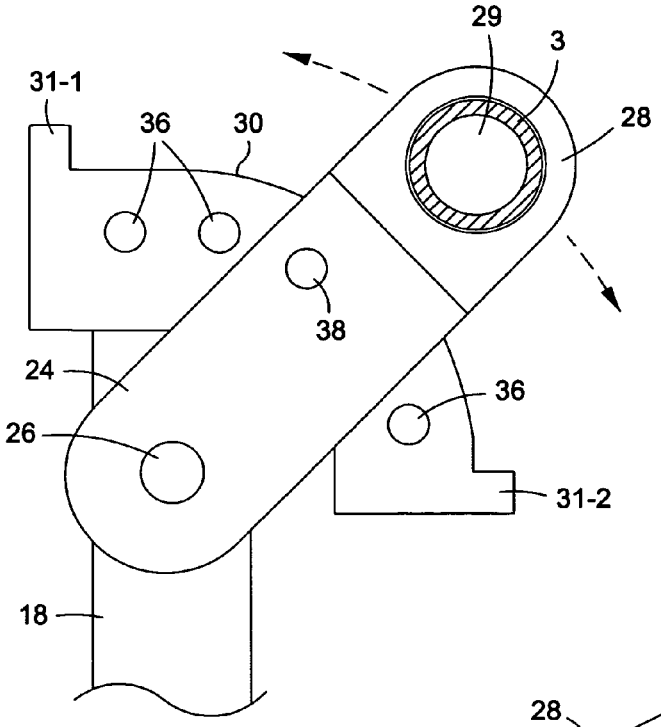
FIGS. 3 and 4 show a rotatable hoop carrier to which the adjustable hoop of the practice device of FIG. 1 is attached.
Figure 4:
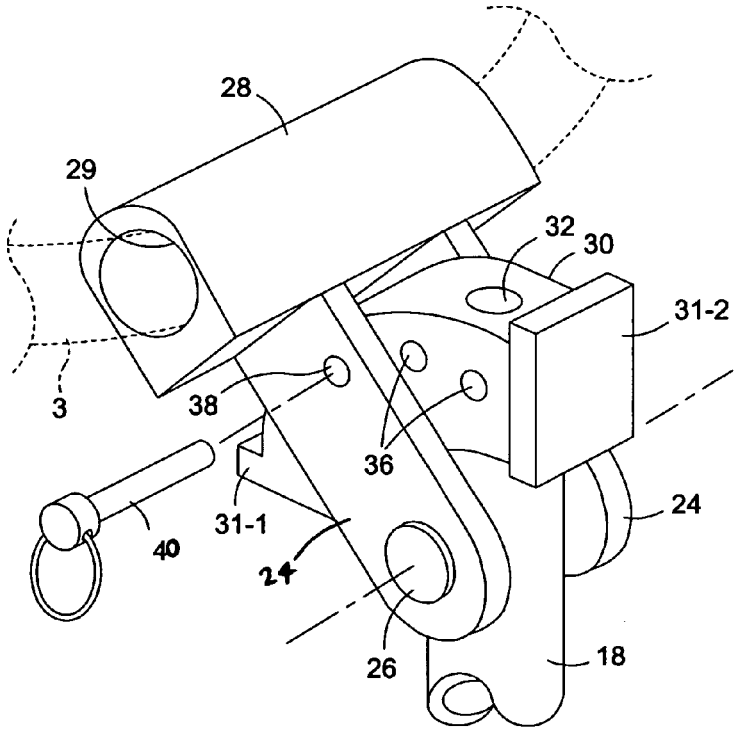

The adjustable hoop 3 is coupled to the upper height adjustment member 18 by means of a hoop carrier having a pair of spaced, parallel-aligned arms 24. Turning to FIGS. 3 and 4 of the drawings, first ends of the hoop carrier arms 24 are shown pivotally connected to the upper height adjustment member 18 by a fastener 26. The fastener 26 extends through axially-aligned openings (now shown) formed through the first ends of the hoop carrier arms 24 and the top of the upper height adjustment member 18 located therebetween such that the hoop carrier arms 24 are rotatable through the aforementioned 90-degree arc relative to member 18. It is preferable that the fastener 26 is detachably connected to and removable from the upper height adjustment member 18 so that the hoop carrier arms 24 can be separated from the training device 1 to facilitate the transport and compact storage thereof.

A mounting sleeve 28 having a channel 29 running longitudinally therethrough is affixed to the opposite ends of the hoop carrier arms 24. The size and shape of the channel 29 through the mounting sleeve 28 corresponds to the size and shape (i.e., cross-section) of the hoop 3. The hoop 3 is received through and retained in frictional engagement with the sleeve 28 so that the sleeve is rotatable above the upper height adjustment member 18 of practice device 1 by means of the hoop carrier arms 24. To this end and as was previously explained, the hoop 3 can be manufactured with a straight bottom (designated 4 in FIG. 1A) to be located within and make a tight fit with the channel 29 through the mounting sleeve 28.

A guide rail 30 having a curved body and stops 31-1 and 31-2 projecting outwardly from opposite ends of the body is connected to the top of the upper height adjustment member 18. A fastener 32 (of FIG. 4) extends through. the guide rail 30 for receipt by a plug (not shown) located within the top of the hollow upper height adjustment member 18 by which to secure the guide rail 30 atop member 18. It is preferable that the fastener 32 be detachably connected to and removable from the upper height adjustment member 18 so that the guide rail 30 can be separated from the training device 1 to facilitate the transport and compact storage thereof.

A series of angle adjustment holes 36 are spaced from one another through the curved body of the guide rail 30. An angle retention hole 38 is formed through each of the pair of rotatable hoop carrier arms 24. The hoop carrier arms 24 are simultaneously rotated along the curved body of guide rail 30 for correspondingly rotating the hoop 3 through the arc between the vertical and horizontal positions (as shown in FIG. 2) relative to the upper height adjustment member 18. The outwardly-projecting stops 31-1 and 31-2 at the opposite ends of the guide rail 30 are sized so as to be able to engage the mounting sleeve 28 and thereby prevent an over-rotation of the hoop carrier arms 24 past the vertical and horizontal positions.

The hoop carrier arms 24 are rotated to a desired position over the guide rail 30 until the hoop 3 that is retained by the mounting sleeve 28 is correspondingly rotated as desired between the vertical and horizontal positions of FIG. 2. A pull ring pin 40 (of FIG. 4) or any other suitable fastener is pushed through the angle retention hole 38 of each of the hoop carrier arms 24 and an axially-aligned one of the angle adjustment holes 36 of the guide rail 30 to prevent a further rotation of the hoop carrier arms 24 and a corresponding displacement of the hoop 3. However, should it be necessary to change the position of the hoop 3 during training, the pull ring pin 40 is pulled out of the angle adjustment and angle retention holes 36 and 38 to allow the hoop carrier arms 24 to again be rotated along the guide rail 30 as is necessary.

Figure 6:
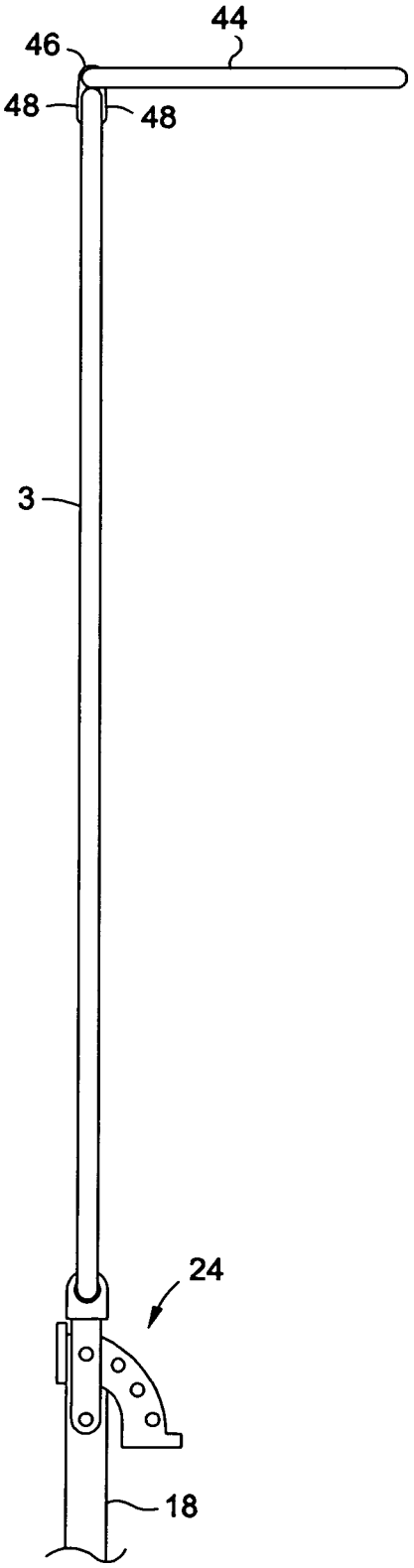
FIGS. 5 and 6 show an optional clip-on serve toss ring to be detachably connected to the adjustable hoop of the training device of FIG. 1.
Figure 5:
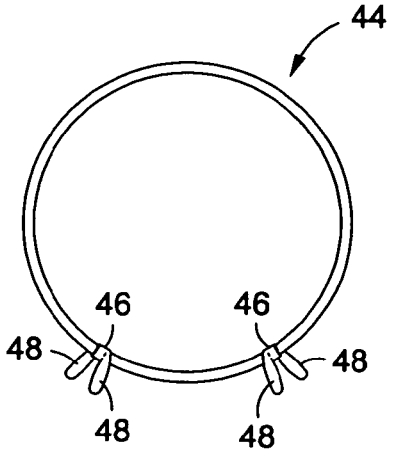

FIGS. 5 and 6 of the drawings show an optional feature of the tennis training device 1 that was described while referring to FIGS. 1-4 to enable the player to practice his serve toss. A clip-on serve toss ring 44 is detachably connected to the hoop 3 of the training device 1 after the hoop has first been rotated (by means of the hoop carrier arms 24) to the vertical position of FIG. 5 standing upwardly from the upper height adjustment member 18. The serve toss ring 44 has a pair of well-known clip fasteners 46. Each clip fastener 46 includes a pair of flexible grasping fingers 48 having a spring memory so that the fingers are urged to close towards one another. The serve toss ring 44 is coupled to the top of the hoop 3 when the hoop is in its vertical position so that the ring 44 projects horizontally outward and in perpendicular alignment therewith by moving the clip fasteners 46 until the hoop is received between the pairs of flexible grasping fingers 48. The serve toss ring 44 has a diameter of about 12 inches to enable the player to practice over time tossing a tennis ball above his head and out in front so that the ball will drop through the ring to simulate a serve.

Figure 7:
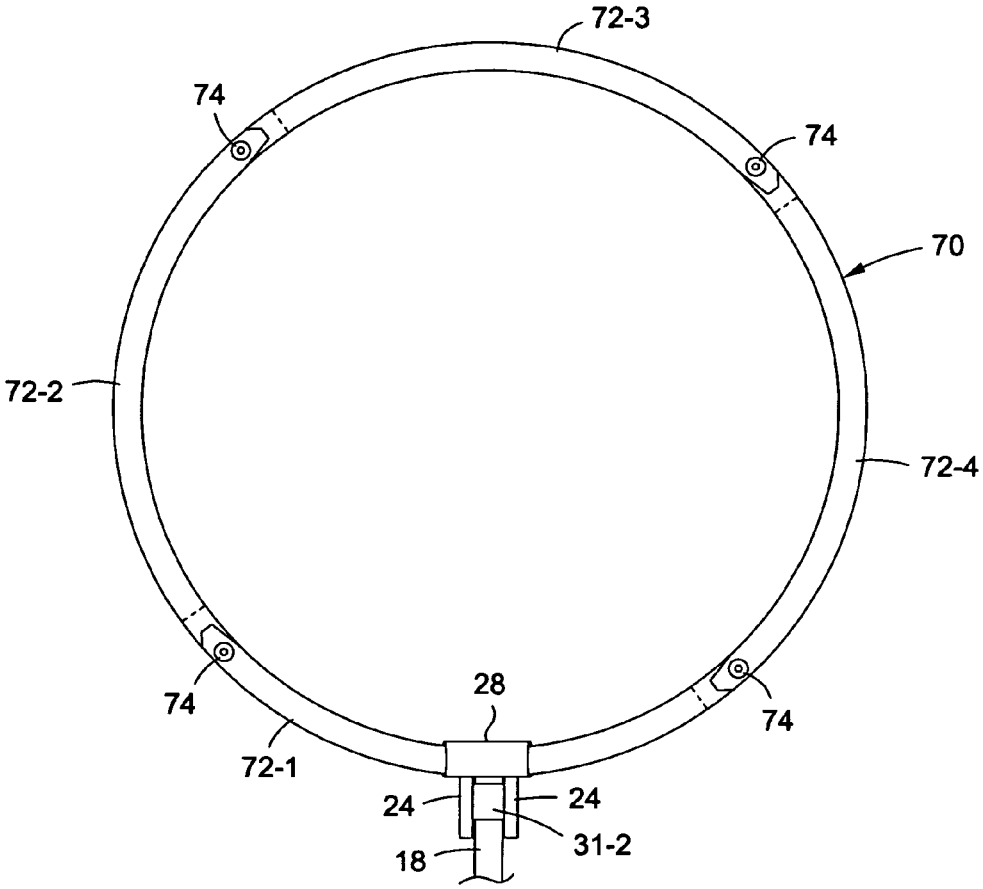
FIGS. 7 and 8 show a modified collapsible hoop to be used by the training device of FIG. 1.
Figure 8:
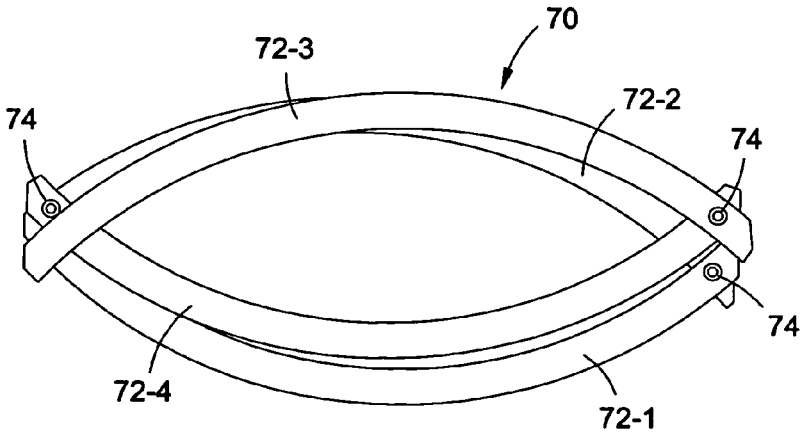

FIGS. 7 and 8 of the drawings show a modified collapsible hoop 70 which can be substituted for the hoop 3 of the tennis training device of FIG. 1. The hoop 70 is formed by a plurality of arcuate hoop segments 72-1 . . . 72-4 that are coupled to one another by means of fasteners 74. The fasteners may be removed from the hoop 70 to permit the hoop segments 72-1 . . . 72-4 to be separated from each other and enable the hoop 70 to be more easily attached to the mounting sleeve 28. Alternatively, the fasteners 74 can be simply loosened to permit the hoop segments 72-1 . . . 72-4 to rotate around the fasteners and collapse together to reduce the size of the hoop 70 and thereby facilitate transport and a compact storage package.

Figure 9:
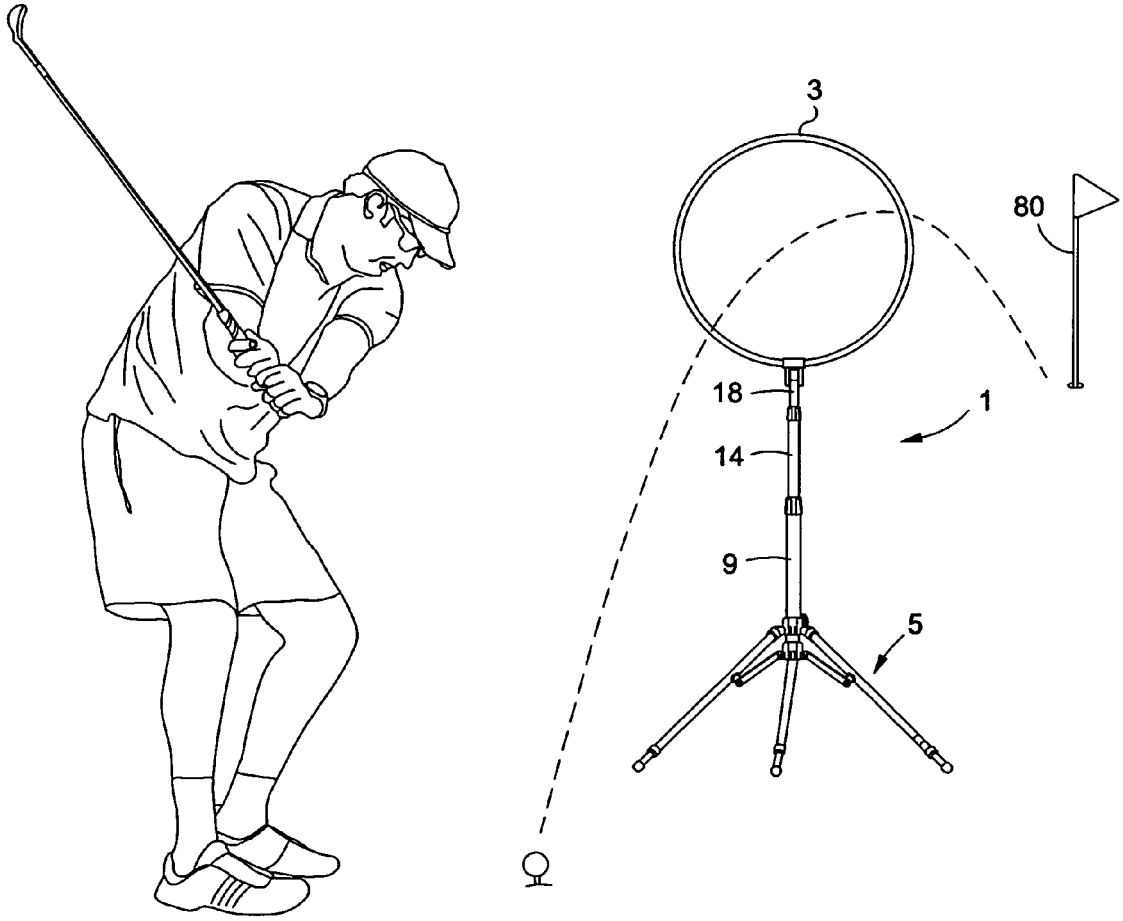
FIG. 9 shows the training device with adjustable hoop according to a second preferred embodiment located at a golf course for use by a golfer.

FIG. 9 of the drawings shows the identical portable training device 1 that was earlier described for use by a tennis player now being used by one practicing his golf swing and technique according to another preferred embodiment of this invention. The stand 5 of the golf training device 1 can be moved to any suitable position at a golf course to enable the player to hit his golf ball through the hoop 3 towards a target 80 (e.g., a flag). In this case, the golfer can adjust the position of the hoop 3 in the manner previously disclosed to practice the line and height of his shots (e.g., drives, pitches, wedge shots, etc.) through the hoop as the practice device is moved to different distances from the target 80.

The invention claimed is:

1. A training device, comprising:

a stand to lay on a flat surface;

a hoop having an opening through which to hit a ball by a user of the training device; and a hoop support having a length and extending between said stand and said hoop to hold said hoop above said stand, said hoop coupled to said hoop support such that said hoop is rotatable relative to said hoop support from a first vertical position axially-aligned with and standing upwardly from said hoop support to a second position; and means for coupling said hoop to said hoop support, said coupling means including a sleeve having a channel running therethrough, said hoop being received through and retained by said sleeve at said channel thereof.

2. The training device recited in claim 1, wherein said hoop is rotatable relative to said hoop support from said first vertical position such that the opening through said hoop faces the user to said second position such that the opening through said hoop faces the flat surface on which said stand is laid.

3. The training device recited in claim 2, wherein said hoop is rotatable through an arc of 90 degrees between said first and second positions.

4. The training device recited in claim 1, wherein the length of said hoop support is adjustable between said stand and said hoop.

5. The training device recited in claim 4, wherein said hoop support includes at least a hollow first height adjustment member interconnected with said stand and a second height adjustment member interconnected with said hoop, said second height adjustment member being slidable inwardly and out of said hollow first height adjustment member to correspondingly adjust the length of said hoop support between said stand and said hoop.

6. The training device recited in claim 5, further comprising a fastener interconnected with each of said first and second height adjustment members to hold said members in a vertical alignment with one another above said stand when said second height adjustment member slides outwardly from said first height adjustment member.

7. The training device recited in claim 1, wherein said hoop has at least one flat side to be received by the channel of said sleeve by which hoop is retained by said sleeve.

8. The training device recited in claim 1, wherein said coupling means also includes a hoop carrier arm extending between said sleeve and said hoop support, said hoop carrier arm being pivotally connected and rotatable relative to said hoop support to cause a corresponding rotation of said sleeve and said hoop retained by said sleeve.

9. The training device recited in claim 8, wherein said coupling means also includes a guide rail connected to said hoop support and having first and second stops located at opposite ends of said guide rail, said hoop carrier arm rotating along said guide rail between the first and second stops thereof.

10. The training device recited in claim 9, wherein each of said hoop carrier arm and said guide rail has a hole extending therethrough, said coupling means also including a fastener located through the holes of said hoop carrier arm and said guide rail to prevent the rotation of said hoop carrier arm along said guide rail.

11. The training device recited in claim 1, further comprising a serve toss ring including at least one clip, said serve toss ring detachably connected to said hoop by means of said clip so that said serve toss ring extends in perpendicular alignment with said hoop.

12. A training device, comprising:

a stand to lay on a flat surface;

a hoop having an opening through which to hit a ball by a user of the training device;

a hoop support having a length and extending between said stand and said hoop to hold said hoop above said stand;

a hoop carrier arm coupled at one end thereof to said hoop and pivotally coupled at the opposite end to said stand so that said hoop carrier arm is rotatable relative to said hoop support to cause a corresponding rotation of said hoop; and a guide rail connected to said hoop support and having first and second stops located therealong, said hoop carrier arm rotating relative to said guide rail between the first and second stops thereof.

13. The training device recited in claim 12, wherein each of said hoop carrier arm and said guide rail has a hole extending therethrough, said training device also comprising a fastener located through the holes of said hoop carrier arm and said guide rail to prevent the rotation of said hoop carrier arm relative to said guide rail.

14. The training device recited in claim 12, wherein said hoop carrier arm is rotatable relative to said hoop support so that said hoop is correspondingly rotated between a vertical position axially aligned with and standing upwardly from said hoop support and a horizontal position perpendicularly aligned with and extending outwardly from said hoop support.

15. The training device recited in claim 14, further comprising a serve toss ring including at least one clip, said serve toss ring detachably connected to said hoop by means of said clip so that said serve toss ring extends in perpendicular alignment with said hoop when said hoop is rotated to said vertical position axially aligned with and standing upwardly from said hoop support.

16. The training device recited in claim 12, wherein said hoop support includes at least a hollow first height adjustment member interconnected with said stand and a second height adjustment member interconnected with said hoop, said second height adjustment member being slidable inwardly and out of said hollow first height adjustment member to correspondingly adjust the length of said hoop support between said stand and said hoop.

17. The training device recited in claim 12, wherein said hoop has a flat side, said hoop carrier arm coupled to said hoop at the flat side thereof.

18. The training device recited in claim 12, wherein said hoop is collapsible from a substantially round configuration to a substantially flat configuration.

19. A method for using a training device to practice one of the games of tennis or golf, wherein said training device includes a stand, a hoop having an opening through which to hit a tennis ball or a golf ball, and a hoop support having a length and extending between said stand and said hoop, said method comprising the steps of:

coupling said hoop to said hoop support so that said hoop is rotatable relative to said hoop support;

rotating said hoop relative to said hoop support between a first vertical position axially-aligned with and standing upwardly from said hoop support to a second horizontal position in perpendicular alignment with said hoop support; and hitting the tennis ball or the golf ball through the hoop when said hoop is in said first vertical position axially aligned with and standing upwardly from said hoop support.

20. The method of using the training device recited in claim 19, wherein said hoop support includes a hollow first height adjustment member interconnected with said stand and a second height adjustment member interconnected with said hoop and being slidable through said hollow first height adjustment member, said method comprising the additional step of sliding said second height adjustment member in at least one direction inwardly or outwardly of said first height adjustment member to correspondingly adjust the length of said hoop support between said stand and said hoop.

* * * * *